US008678836B2

(12) United States Patent
Kenzaki et al.

(10) Patent No.: US 8,678,836 B2
(45) Date of Patent: Mar. 25, 2014

(54) COAXIAL CONNECTOR PLUG AND MANUFACTURING METHOD THEREOF

(71) Applicant: Murata Manufacturing Co., Ltd., Kyoto-fu (JP)

(72) Inventors: Shinichi Kenzaki, Kyoto-fu (JP); Yukihiro Kitaichi, Kyoto-fu (JP); Hiroki Wakamatsu, Kyoto-fu (JP); Takashi Maruyama, Kyoto-fu (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 0 days.

(21) Appl. No.: 13/693,888

(22) Filed: Dec. 4, 2012

(65) Prior Publication Data

US 2013/0143437 A1 Jun. 6, 2013

(30) Foreign Application Priority Data

Dec. 5, 2011 (JP) ..... 2011-265569

(51) Int. Cl.
*H01R 9/05* (2006.01)

(52) U.S. Cl.
USPC ..... 439/63

(58) Field of Classification Search
USPC ..... 439/578, 63, 620.03
See application file for complete search history.

(56) References Cited

U.S. PATENT DOCUMENTS

| | | | | |
|---|---|---|---|---|
| 6,099,334 | A * | 8/2000 | Togashi | 439/188 |
| 6,554,630 | B2 * | 4/2003 | Uratani | 439/188 |
| 6,751,317 | B2 * | 6/2004 | Shima et al. | 379/438 |
| 6,808,405 | B1 * | 10/2004 | Uratani et al. | 439/188 |
| 7,632,112 | B2 * | 12/2009 | Wakamatsu et al. | 439/83 |
| 7,794,253 | B2 * | 9/2010 | Wang et al. | 439/188 |
| 2001/0027033 | A1 * | 10/2001 | Fujimoto et al. | 439/63 |

FOREIGN PATENT DOCUMENTS

| | | | |
|---|---|---|---|
| JP | 05-006755 | U | 1/1993 |
| JP | 08-037063 | A | 2/1996 |
| JP | 2009-104836 | A | 5/2009 |

* cited by examiner

*Primary Examiner* — Neil Abrams
*Assistant Examiner* — Travis Chambers
(74) *Attorney, Agent, or Firm* — Studebaker & Brackett PC

(57) ABSTRACT

An outer conductor portion includes an outer conductor and a pair of outer terminals. The outer conductor is formed into a substantially cylindrical shape extending in the z-axis direction. The outer terminals are drawn toward the positive z-axis direction side of the outer conductor. In a plan view in the z-axis direction, the outer terminals are each bent in a direction outwardly from the outer conductor, and face each other across the outer conductor. An insulator has two sides, an upper surface in contact with a positive z-axis direction-side end portion of the outer conductor, and a lower surface in contact with the outer terminals at the sides, and thereby is nipped by the outer conductor portion in the z-axis direction. A central conductor is attached to the insulator, and is provided in a region surrounded by the outer conductor.

11 Claims, 8 Drawing Sheets

COAXIAL CONNECTOR PLUG AND MANUFACTURING METHOD THEREOF

CROSS REFERENCE TO RELATED APPLICATIONS

The present application claims priority to Japanese Patent Application No. 2011-265569 filed on Dec. 5, 2011, the entire contents of this application being incorporated herein by reference in their entirety.

TECHNICAL FIELD

The technical field relates to a coaxial connector plug and a manufacturing method thereof, more specifically to a coaxial connector plug including a substantially cylindrical outer conductor and a central conductor provided in the outer conductor and a manufacturing method thereof.

BACKGROUND

As a related-art coaxial connector plug, a connector plug described in Japanese Unexamined Patent Application Publication No. 2009-104836 (hereinafter referred to as "Patent Document 1"), for example, is known. FIG. 13 is a cross-sectional structure diagram of a connector plug 510 described in Patent Document 1.

As illustrated in FIG. 13, the connector plug 510 includes a substantially socket-shaped central conductor 512, a central conductor joining portion 514, an outer conductor 516, and an insulating housing 518. The outer conductor 516 is formed into a substantially cylindrical shape extending in the vertical direction, and is maintained at a ground potential. The substantially socket-shaped central conductor 512 is provided at the center of the outer conductor 516, and is formed into a substantially cylindrical shape extending in the vertical direction. A high-frequency signal is input to and output from the substantially socket-shaped central conductor 512. The central conductor joining portion 514 is connected to the substantially socket-shaped central conductor 512, and is drawn in the horizontal direction. The insulating housing 518 is a resin member for fixing the substantially socket-shaped central conductor 512 at the center of the outer conductor 516.

Meanwhile, the connector plug 510 described in Patent Document 1 has an issue in that a reduction in height thereof is difficult. More specifically, the substantially socket-shaped central conductor 512 and the central conductor joining portion 514 are integrally molded with the insulating housing 518. The substantially socket-shaped central conductor 512, the central conductor joining portion 514, and the insulating housing 518 integrated together are attached to the outer conductor 516 via a lower opening of the outer conductor 516. Then, a front end bent piece 516*a* and a rear end bent piece 516*b* of the outer conductor 516 are bent. Thereby, the insulating housing 518 is nipped between the front end bent piece 516*a* and the rear end bent piece 516*b* in the vertical direction. Accordingly, the insulating housing 518 is fixed to the outer conductor 516.

SUMMARY

The present disclosure provides a coaxial connector plug that can achieve a reduction in height of the coaxial connector plug and a manufacturing method thereof.

A coaxial connector plug according to an embodiment includes a first outer conductor portion, a substantially plate-shaped insulator, and a first central conductor. The first outer conductor portion includes a first outer conductor formed into a substantially cylindrical shape extending in an axial direction, and a pair of outer terminals drawn toward a side of the first outer conductor that faces in the axial direction. In a plan view, the outer terminals are each bent in a direction outwardly from the first outer conductor, and face each other across the first outer conductor. The insulator has a pair of oppositely facing sides, a first surface in contact with a lower end of the first outer conductor, and a second surface opposite the first surface in contact with the pair of outer terminals at the pair of oppositely facing sides, and thereby is nipped by the first outer conductor and the pair of outer terminals in the axial direction. The first central conductor is attached to the insulator, and is provided in a region surrounded by the first outer conductor.

A manufacturing method of the foregoing coaxial connector plug according to an embodiment includes a first step of attaching the first outer conductor portion to the insulator attached with the first central conductor, and a second step of nipping the pair of outer terminals in the horizontal direction and thereby plastically deforming the pair of outer terminals to bring the pair of outer terminals into contact with the lower surface of the insulator.

Other features, elements, characteristics and advantages will become more apparent from the following detailed description of exemplary embodiments with reference to the attached drawings.

DETAILED DESCRIPTION

Figure 13:
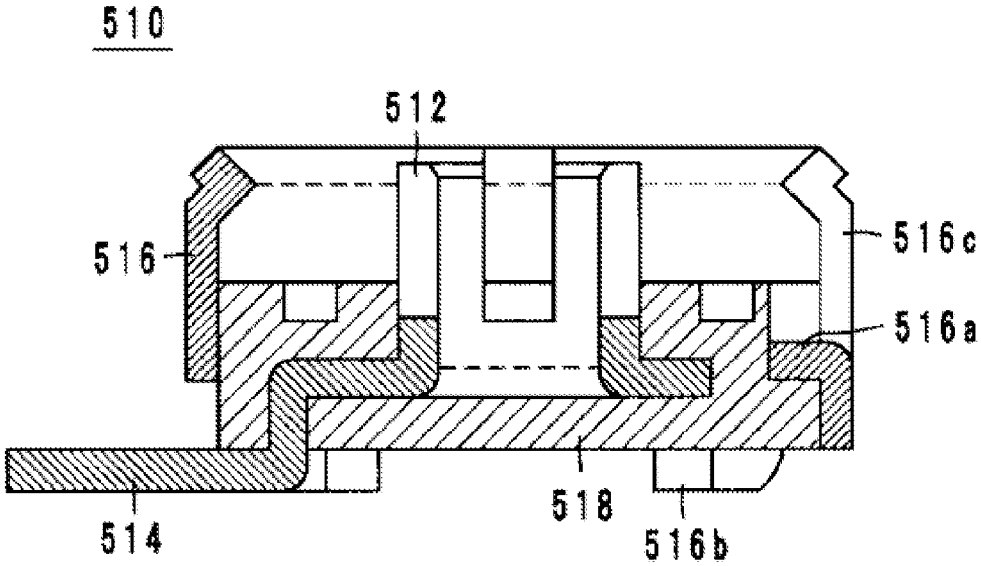
FIG.13 Prior Art
FIG. 13 is a cross-sectional structure diagram of a connector plug described in Patent Document 1.

Referring again to FIG. 13, to form the front end bent piece 516*a* to the outer conductor 516, a cutout 516*c* extending in the vertical direction needs to be formed in the substantially cylindrical outer conductor 516. The inventors realized that if such a cutout 516*c* is formed, the strength of the outer conductor 516 is reduced, and that it is therefore necessary to increase the height of the outer conductor 516. As a result, it is difficult to reduce the height of the connector plug 510 described in Patent Document 1.

Exemplary embodiments of a coaxial connector plug and a manufacturing method thereof that can address the above shortcomings will now be described.

Figure 1:
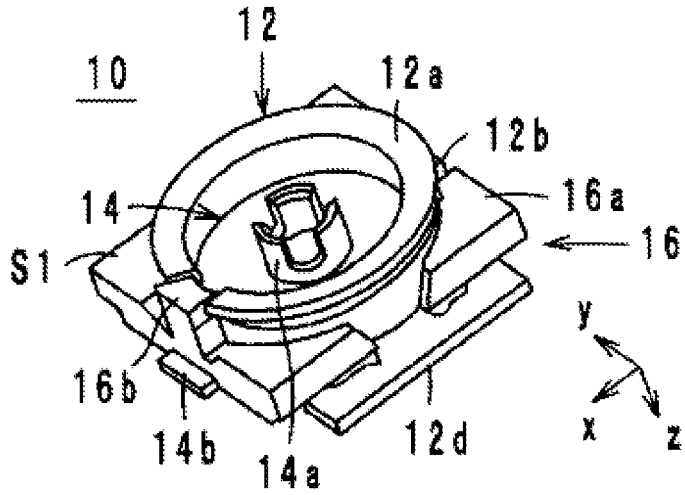
FIG. 1 is an external perspective view of a coaxial connector plug according to an exemplary embodiment.
Figure 3:
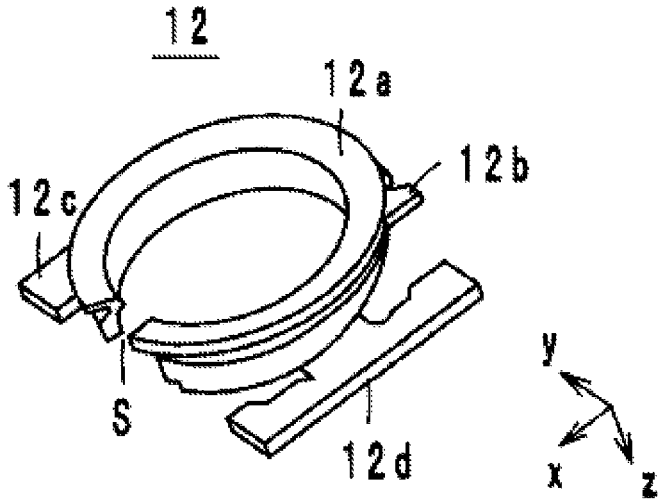
FIG. 3 is an external perspective view of an outer conductor portion of the coaxial connector plug.
Figure 2A:
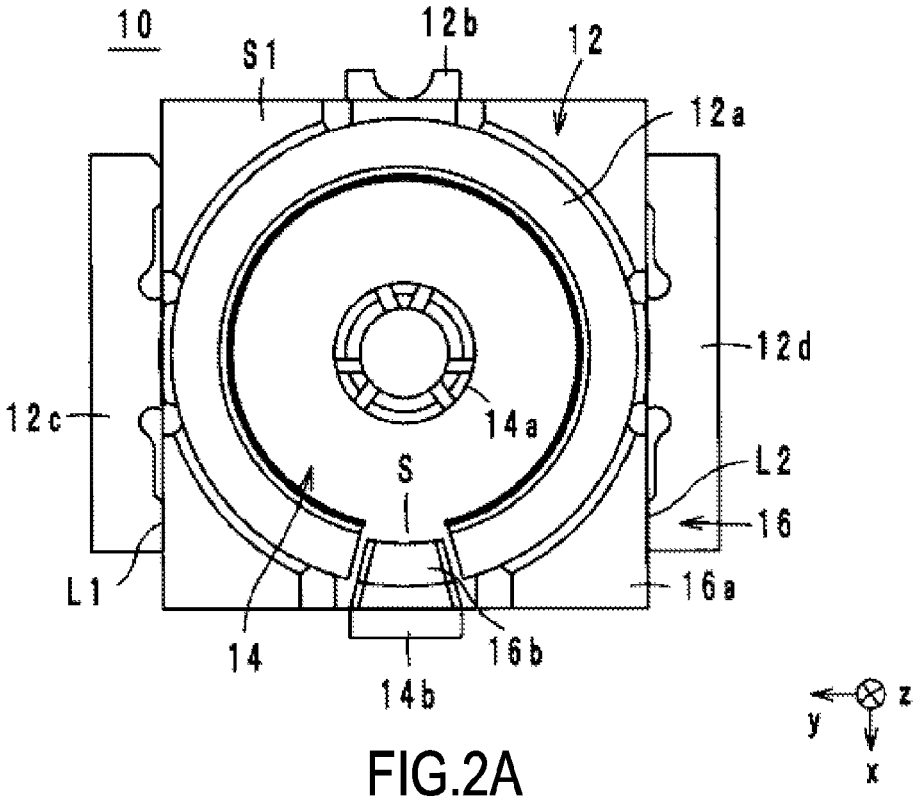
FIG. 2A is a top view of the coaxial connector plug.
Figure 2B:
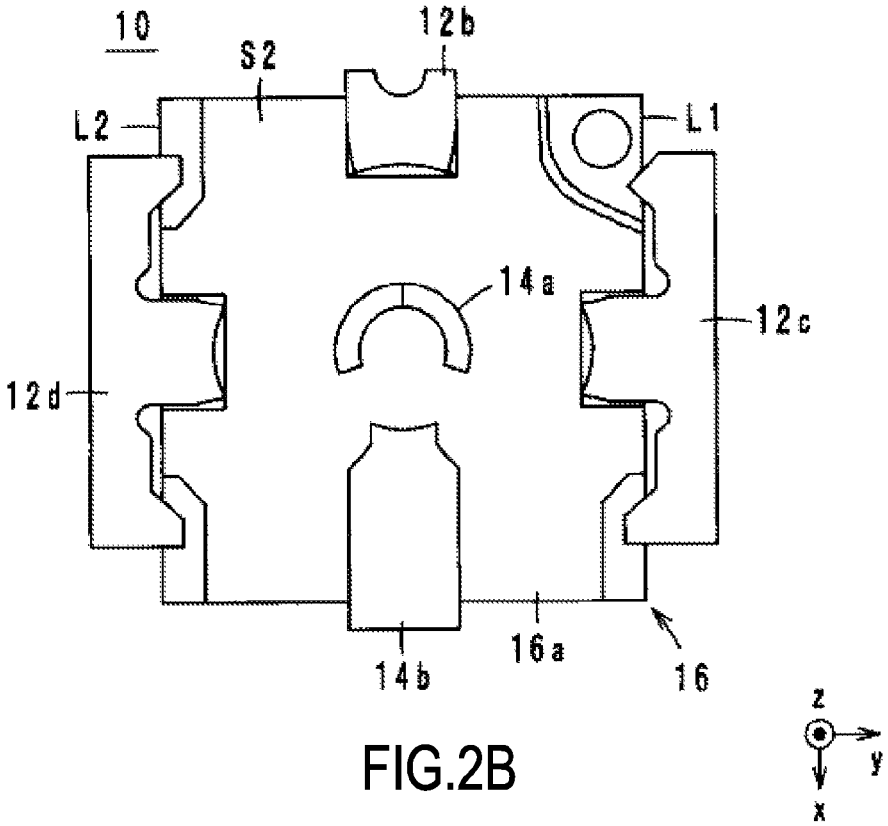
FIG. 2B is a bottom view of the coaxial connector plug.
Figure 4:
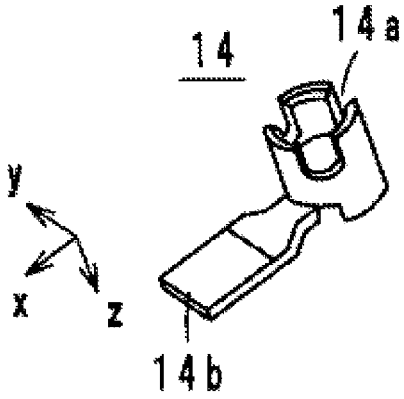
FIG. 4 is an external perspective view of a central conductor portion of the coaxial connector plug.
Figure 5:
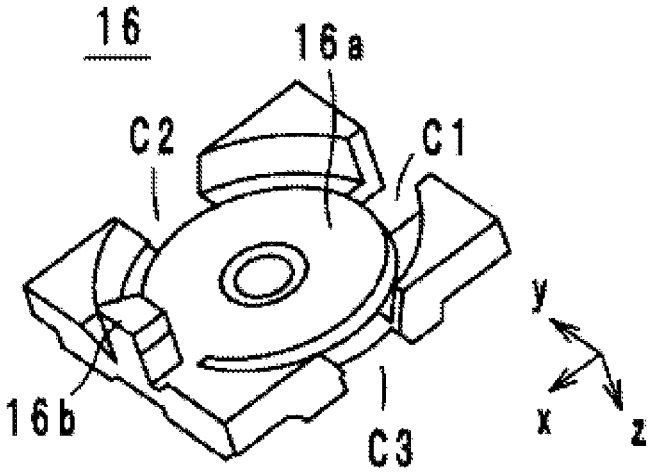
FIG. 5 is an external perspective view of an insulator.
Figure 6:
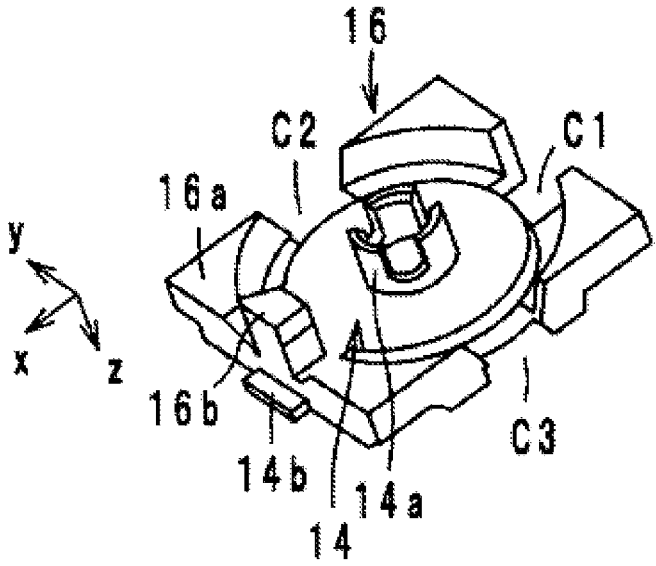
FIG. 6 is a diagram illustrating the coaxial connector plug in an assembly process.

A coaxial connector plug 10 according to an embodiment will be first described with reference to drawings. FIG. 1 is an external perspective view of the coaxial connector plug 10. FIG. 2A is a top view of the coaxial connector plug 10, and FIG. 2B is a bottom view of the coaxial connector plug 10. FIG. 3 is an external perspective view of an outer conductor portion 12 of the coaxial connector plug 10. FIG. 4 is an external perspective view of a central conductor portion 14 of the coaxial connector plug 10. FIG. 5 is an external perspective view of an insulator 16. FIG. 6 is a diagram illustrating the coaxial connector plug 10 in an assembly process.

In the following, a normal direction of the insulator 16 in FIG. 1 is defined as the z-axis direction. Further, in a plan view in the z-axis direction, directions respectively parallel to two mutually perpendicular sides of the insulator 16 are defined as the x-axis direction and the y-axis direction. The x-axis direction, the y-axis direction, and the z-axis direction are perpendicular to one another. Further, the z-axis direction is parallel to the vertical, or axial direction.

A later-described coaxial connector receptacle is attached to the coaxial connector plug 10 from the lower side of the coaxial connector plug 10. That is, when in use, the coaxial connector plug 10 is used with an opening thereof facing downward. However, it is assumed for convenience that the upward direction in FIG. 1 denotes the upward vertical direction, and that the downward direction in FIG. 1 denotes the downward vertical direction. Further, the downward direction in FIG. 1 is defined as the positive z-axis direction, and the upward direction in FIG. 1 is defined as the negative z-axis direction. Further, the direction of an arrow x in FIG. 1 is defined as the positive x-axis direction, and a direction opposite thereto is defined as the negative x-axis direction. Further, the direction of an arrow y in FIG. 1 is defined as the positive y-axis direction, and a direction opposite thereto is defined as the negative y-axis direction.

The coaxial connector plug 10 can be mounted on a circuit board, such as a flexible printed board, and includes the outer conductor portion 12, the central conductor portion 14, and the insulator 16, as illustrated in FIG. 1 and FIGS. 2A and 2B.

The outer conductor portion 12 is formed by one conductive flexible metal plate (made of phosphor bronze, for example) subjected to a punching process and a bending process. Further, the outer conductor portion 12 can be plated with silver or gold. As illustrated in FIGS. 1 and 3, the outer conductor portion 12 includes an outer conductor 12*a* and outer terminals 12*b* to 12*d*. As illustrated in FIGS. 1 to 3, the outer conductor 12*a* is formed into a substantially cylindrical shape extending in the z-axis direction, which is an axial direction of the substantially cylindrical shape.

Further, as illustrated in FIG. 3, the outer conductor 12*a* is provided with a slit S. The slit S is provided to substantially linearly connect a positive z-axis direction-side end portion and a negative z-axis direction-side end portion of the outer conductor 12*a*. In a plan view from the negative z-axis direction side, therefore, the outer conductor 12*a* has a substantially C-shape, not a substantially ring shape.

As illustrated in FIGS. 2A and 2B and FIG. 3, the outer terminals 12*b* to 12*d* are connected to the outer conductor 12*a*, and are provided to the positive z-axis direction side of the outer conductor 12*a*. The outer terminal 12*b* is drawn toward the positive z-axis direction side of the outer conductor 12*a*, and is bent in the negative x-axis direction.

As illustrated in FIGS. 2A and 2B and FIG. 3, the outer terminals 12*c* and 12*d* are drawn toward the positive z-axis direction side of the outer conductor 12*a*. Further, in the plan view from the negative z-axis direction side, the outer terminals 12*c* and 12*d* are each bent in a direction separating from, or outwardly from the outer conductor 12*a*, and face each other across the outer conductor 12*a*. More specifically, the outer terminal 12*c* is connected to a positive y-axis direction-side portion of the negative z-axis direction-side end portion of the outer conductor 12*a*, and is bent in the positive y-axis direction. Further, in a plan view in the z-axis direction, the outer terminal 12*c* extends in the x-axis direction, and projects in the negative y-axis direction at opposite ends thereof. Meanwhile, the outer terminal 12*d* is connected to a negative y-axis direction-side portion of the negative z-axis direction-side end portion of the outer conductor 12*a*, and is bent in the negative y-axis direction. Further, in the plan view in the z-axis direction, the outer terminal 12*d* extends in the x-axis direction, and projects in the positive y-axis direction at opposite ends thereof.

The central conductor portion 14 is formed by one metal plate (made of phosphor bronze, for example) subjected to a punching process and a bending process. Further, the central conductor portion 14 can be plated with silver or gold. As illustrated in FIGS. 1 and 4, the central conductor portion 14 includes a central conductor 14*a* and an outer terminal 14*b*.

As illustrated in FIG. 1 and FIGS. 2A and 2B, in the plan view in the z-axis direction, the central conductor 14*a* is provided in a region surrounded by the outer conductor 12*a* (more specifically, at the center of the outer conductor 12*a*). Further, as illustrated in FIG. 4, the central conductor 14*a* is formed into a substantially cylindrical shape extending in the z-axis direction. The central conductor 14*a* is provided with three slits extending in the vertical direction. Accordingly, the central conductor 14*a* is slightly extendable in the horizontal direction.

As illustrated in FIG. 4, the outer terminal 14*b* is connected to a positive z-axis direction-side end portion of the central conductor 14*a*, and substantially linearly extends along the positive x-axis direction (i.e., a direction perpendicular to the central axis of the central conductor 14*a*). As illustrated in FIG. 1 and FIGS. 2A and 2B, in the plan view in the z-axis direction, the outer terminal 14*b* faces the outer terminal 12*b* across the center of the outer conductor 12*a*.

The insulator 16 is made of an insulating material, such as a resin, and includes a base portion 16*a* and a projection 16*b*, as illustrated in FIG. 5. As illustrated in FIGS. 2A and 2B, in the plan view in the z-axis direction, the base portion 16*a* is a substantially rectangular, substantially plate-shaped member having a pair of mutually facing sides L1 and L2. The side L1 is located on the positive y-axis direction side, and extends in the x-axis direction. The side L2 is located on the negative y-axis direction side, and extends in the x-axis direction. Further, a negative z-axis direction-side main surface of the base portion 16*a* is referred to as an upper surface S1, and a positive z-axis direction-side main surface of the base portion 16*a* is referred to as a lower surface S2.

Further, as illustrated in FIG. 5, the base portion 16*a* is provided with notches, or cutouts C1 to C3. The cutout C1 is formed by removal of a central portion of a negative x-axis direction side of the base portion 16*a*. The cutout C2 is formed by removal of a central portion of a positive y-axis direction side of the base portion 16*a*. The cutout C3 is formed by removal of a central portion of a negative y-axis direction side of the base portion 16*a*.

The projection 16*b* is formed by projection in the negative z-axis direction of a central portion of a positive x-axis direction side of the base portion 16*a*.

The central conductor portion 14 is attached to the insulator 16. More specifically, the central conductor portion 14 and the insulator 16 are integrally molded by insert molding, as illustrated in FIG. 6. Thereby, the central conductor 14*a* projects in the negative z-axis direction at the center of the base portion 16*a*. Further, as illustrated in FIG. 2B, the central conductor 14*a* is exposed from a positive z-axis direction-side surface of the insulator 16. Further, on the positive z-axis direction side of the projection 16*b*, the outer terminal 14*b* of the central conductor portion 14 is drawn from the insulator 16 in the positive x-axis direction.

Further, the outer conductor portion 12 is attached to the insulator 16. More specifically, the positive z-axis direction-side end portion of the outer conductor 12*a* is in contact with the upper surface S1 of the base portion 16*a*, as illustrated in FIG. 1. Further, the outer terminals 12*b* to 12*d* are drawn toward the positive z-axis direction side of the insulator 16 via the cutouts C1 to C3. Further, the outer terminals 12*c* and 12*d* extend in the x-axis direction, as illustrated in FIGS. 2A and 2B, and thus extend along the sides L1 and L2. Further, the opposite ends of the outer terminal 12*c* project in the negative y-axis direction, and the opposite ends of the outer terminal 12*d* project in the positive y-axis direction. Therefore, the opposite ends of each of the outer terminals 12*c* and 12*d* are located under the lower surface S2 of the base portion 16*a*. Accordingly, opposite ends of a positive z-axis direction-side surface of the outer terminal 12*c* and opposite ends of a positive z-axis direction-side surface of the outer terminal 12*d* are in contact with the lower surface S2 at the sides L1 and L2, respectively. With the outer conductor portion 12 attached to the insulator 16 in the above-described manner, the insulator 16 is nipped by the outer conductor portion 12 from opposite sides in the z-axis direction.

Further, as illustrated in FIG. 1, the projection 16*b* is located in the slit S. That is, the projection 16*b* functions as a cover member for covering the slit S. The projection 16*b*, however, is not in contact with the outer conductor 12*a*, as illustrated in FIG. 2A. That is, there is a slight gap between the projection 16*b* and the outer conductor 12*a*. Accordingly, the outer conductor 12*a* is slightly deformable in a direction of reducing the diameter thereof.

Figure 7A:
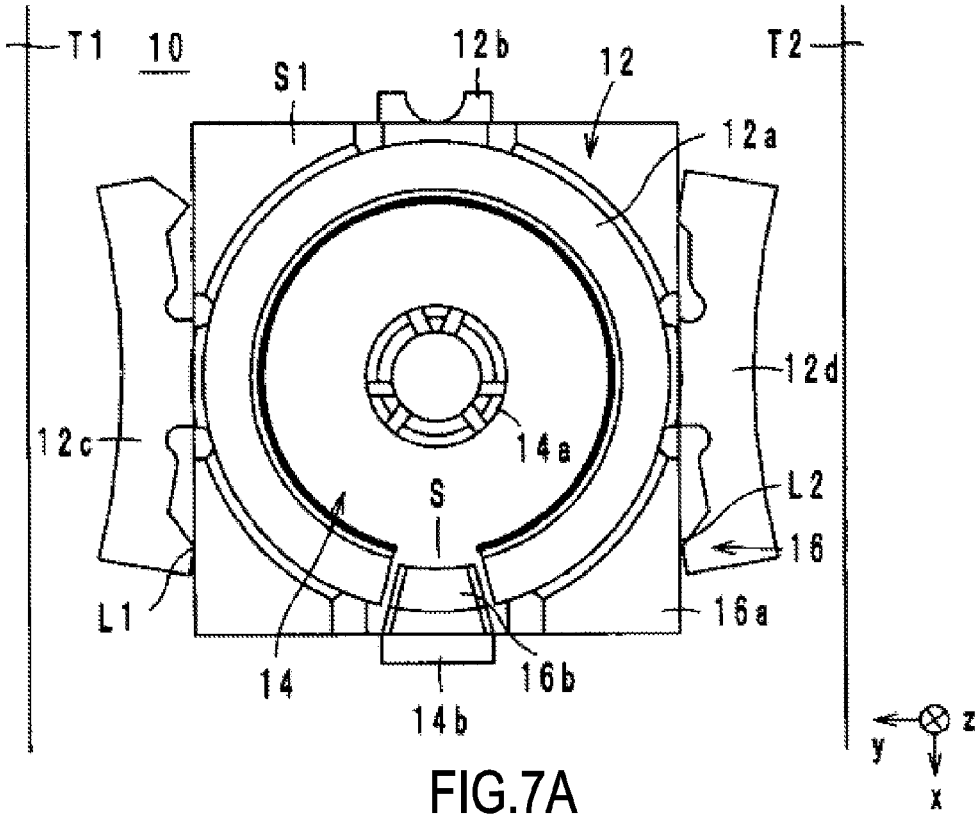
FIG. 7A is a top view of the coaxial connector plug in a manufacturing process.
Figure 7B:
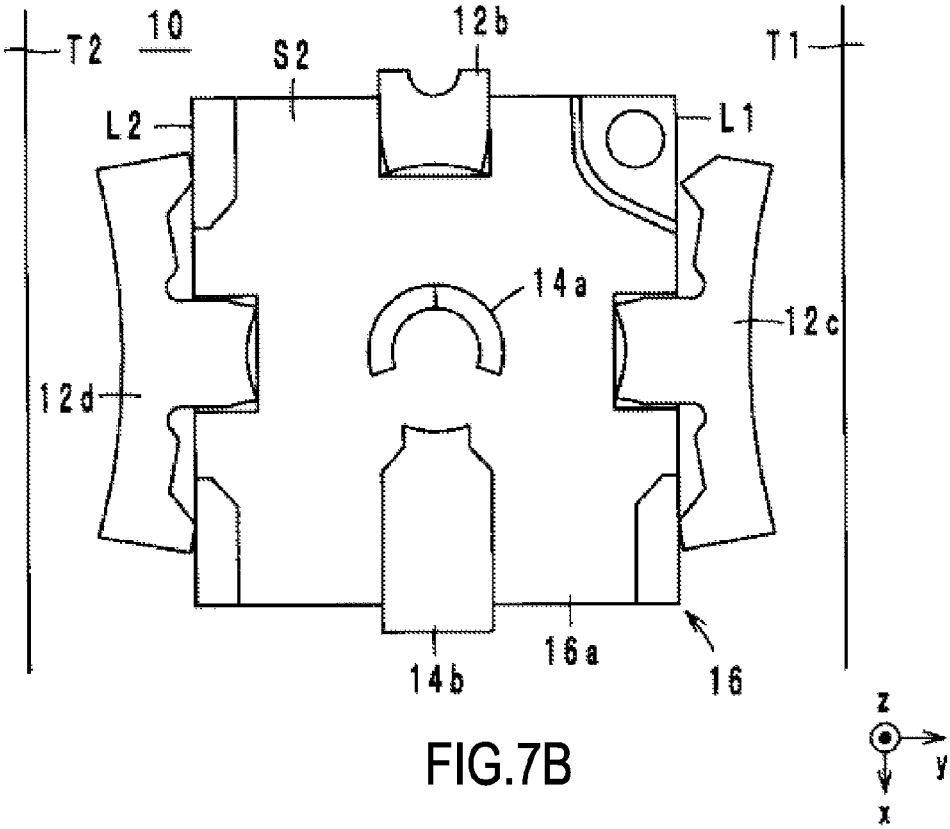
FIG. 7B is a bottom view of the coaxial connector plug in the manufacturing process.

An exemplary manufacturing method of the coaxial connector plug 10 will be described below with reference to drawings. FIG. 7A is a top view of the coaxial connector plug 10 in a manufacturing process. FIG. 7B is a bottom view of the coaxial connector plug 10 in the manufacturing process. Herein, the attachment of the outer conductor portion 12 to the insulator 16 will mainly be described.

As illustrated in FIG. 6, the central conductor portion 14 and the insulator 16 are first integrally molded by insert molding.

Then, as illustrated in FIGS. 7A and 7B, the outer conductor portion 12 is attached to the insulator 16 attached with the central conductor portion 14. Specifically, the outer conductor 12*a* is placed on the upper surface S1, and the outer terminals 12*b* to 12*d* are drawn toward the positive z-axis direction side of the base portion 16*a* via the cutouts C1 to C3. In the state of FIGS. 7A and 7B, however, the outer terminal 12*c* is bent such that a central portion thereof in the x-axis direction projects in the negative y-axis direction in the plan view in the z-axis direction. Further, the outer terminal 12*d* is bent such that a central portion thereof in the x-axis direction projects in the positive y-axis direction. This is for preventing the opposite ends of each of the outer terminals 12*c* and 12*d* from being caught by the insulator 16 in the process of attachment to the insulator 16.

Then, to bring the outer terminals 12*c* and 12*d* into contact with the lower surface S2 of the base portion 16*a*, the outer terminals 12*c* and 12*d* are nipped in the horizontal direction, and thereby are plastically deformed. More specifically, tools T1 and T2 each having a surface parallel to the x-z plane are prepared. Then, the outer terminals 12*c* and 12*d* are nipped by the tools T1 and T2 from opposite sides in the y-axis direction. Thereby, each of the bent outer terminals 12*c* and 12*d* is plastically deformed into a substantially linear shape, as illustrated in FIGS. 2A and 2B. As a result, each of the outer terminals 12*c* and 12*d* is in contact with the lower surface S2 at the opposite ends thereof. The coaxial connector plug 10 is completed through the above-described processes.

Figure 8:
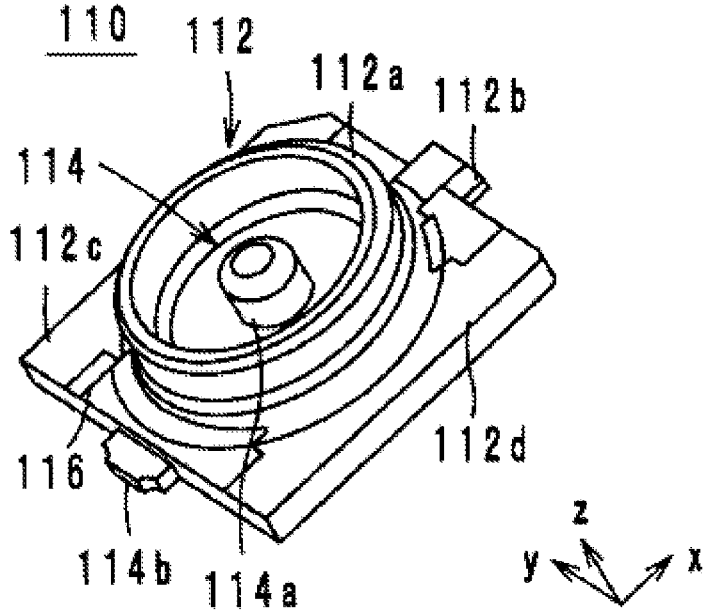
FIG. 8 is an external perspective view of a coaxial connector receptacle according to an exemplary embodiment.
Figure 9:
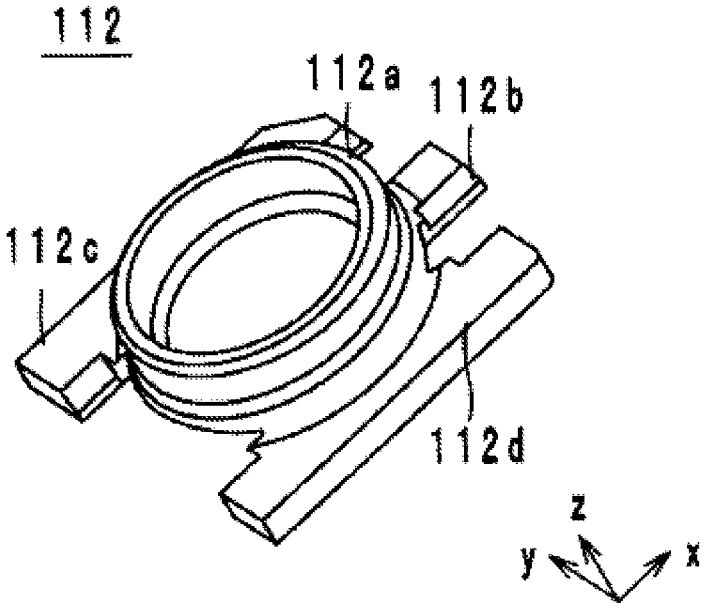
FIG. 9 is an external perspective view of an outer conductor portion of the coaxial connector receptacle.
Figure 10:
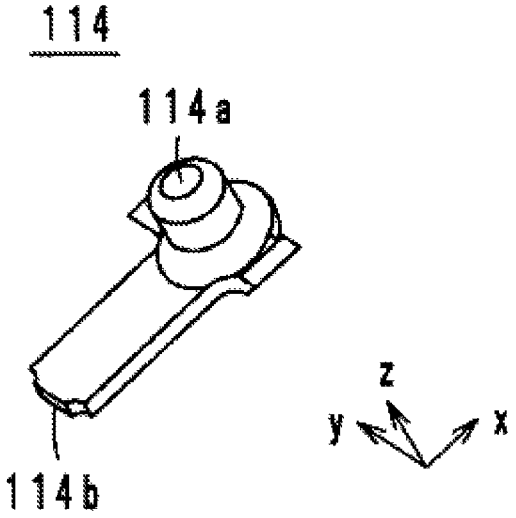
FIG. 10 is an external perspective view of a central conductor portion of the coaxial connector receptacle.
Figure 11:
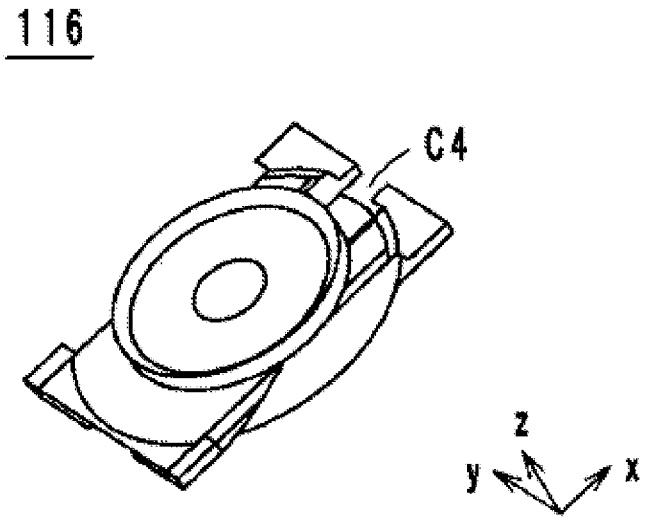
FIG. 11 is an external perspective view of an insulator of the coaxial connector receptacle.

With reference to drawings, description will now be made of a coaxial connector receptacle 110, which is attached to the coaxial connector plug 10 according to an exemplary embodiment. FIG. 8 is an external perspective view of an exemplary coaxial connector receptacle 110. FIG. 9 is an external perspective view of an outer conductor portion 112 of the coaxial connector receptacle 110. FIG. 10 is an external perspective view of a central conductor portion 114 of the coaxial connector receptacle 110. FIG. 11 is an external perspective view of an insulator 116 of the coaxial connector receptacle 110.

In the following, a normal direction of the insulator 116 in FIG. 8 is defined as the z-axis direction. Further, in a plan view in the z-axis direction, directions respectively parallel to two mutually perpendicular sides of the insulator 116 are defined as the x-axis direction and the y-axis direction. The x-axis direction, the y-axis direction, and the z-axis direction are perpendicular to one another. Further, the z-axis direction is parallel to the vertical direction.

The coaxial connector receptacle 110 is attached to the coaxial connector plug 10 from the lower side of the coaxial connector plug 10. That is, when in use, the coaxial connector receptacle 110 is used with an opening thereof facing upward. Therefore, the upward direction in FIG. 8 denotes the upward vertical direction, and the downward direction in FIG. 8 denotes the downward vertical direction. Accordingly, the upward direction in FIG. 8 is defined as the positive z-axis direction, and the downward direction in FIG. 8 is defined as the negative z-axis direction.

The coaxial connector receptacle 110 can be mounted on a circuit board, such as a flexible printed board, and includes the outer conductor portion 112, the central conductor portion 114, and the insulator 116, as illustrated in FIG. 8.

The outer conductor portion 112 is formed by one conductive flexible metal plate (made of phosphor bronze, for example) subjected to a punching process and a bending process. Further, the outer conductor portion 112 can be plated with silver or gold. As illustrated in FIGS. 8 and 9, the outer conductor portion 112 includes an outer conductor 112*a* and outer terminals 112*b* to 112*d*. As illustrated in FIGS. 8 and 9, the outer conductor 112*a* is formed into a substantially cylindrical shape extending in the z-axis direction.

The outer terminals 112*b* to 112*d* are connected to the outer conductor 112*a*, and are provided to the negative z-axis direction side of the outer conductor 112*a*. The outer terminal 112*b* is drawn from the outer conductor 112*a* in the negative z-axis direction, and is bent in the positive x-axis direction. The outer terminal 112*c* is drawn from the outer conductor 112*a* in the negative z-axis direction, and is bent in the positive y-axis direction. Further, the outer terminal 112*c* is formed into a substantially T-shape in the plan view in the z-axis direction. The outer terminal 112*d* is drawn from the outer conductor

112*a* in the negative z-axis direction, and is bent in the negative y-axis direction. Further, the outer terminal 112*d* is formed into a substantially T-shape in the plan view in the z-axis direction.

The central conductor portion 114 is formed by one metal plate (made of phosphor bronze, for example) subjected to a punching process and a bending process. Further, the central conductor portion 114 can be plated with silver or gold. As illustrated in FIGS. 8 and 10, the central conductor portion 114 includes a central conductor 114*a* and an outer terminal 114*b*.

As illustrated in FIG. 8, the central conductor 114*a* is provided to extend in the z-axis direction at the center of the outer conductor 112*a*. That is, in the plan view in the z-axis direction, the central conductor 114*a* is surrounded by the outer conductor 112*a*. Further, as illustrated in FIG. 10, the central conductor 114*a* is formed into a substantially cylindrical shape extending in the z-axis direction.

As illustrated in FIG. 10, the outer terminal 114*b* is connected to a negative z-axis direction-side end portion of the central conductor 114*a*, and extends in the negative x-axis direction. As illustrated in FIG. 8, in the plan view in the z-axis direction, the outer terminal 114*b* faces the outer terminal 112*b* across the center of the outer conductor 112*a*.

The insulator 116 is made of an insulating material, such as a resin, and is formed into a substantially rectangular shape in the plan view in the z-axis direction, as illustrated in FIGS. 8 and 11. The insulator 116 is provided with a cutout C4. The cutout C4 is formed by removal of a central portion of a positive x-axis direction side of the insulator 116.

The outer conductor portion 112, the central conductor portion 114, and the insulator 116 are integrally molded by insert molding. Thereby, the outer conductor 112*a* projects in the positive z-axis direction at the center of the insulator 116. Further, a negative z-axis direction-side end portion of the outer conductor 112*a* is covered by the insulator 116. The outer terminal 112*b* is drawn outside the insulator 116 via the cutout C4. Further, the outer terminals 112*c* and 112*d* are drawn outside the insulator 116 from a positive y-axis direction side and a negative y-axis direction side of the insulator 116, respectively. Further, the central conductor 114*a* projects in the positive z-axis direction from the insulator 116 in a region surrounded by the outer conductor 112*a*. Further, the outer terminal 114*b* is drawn from the insulator 116 in the negative x-axis direction.

Figure 12A:
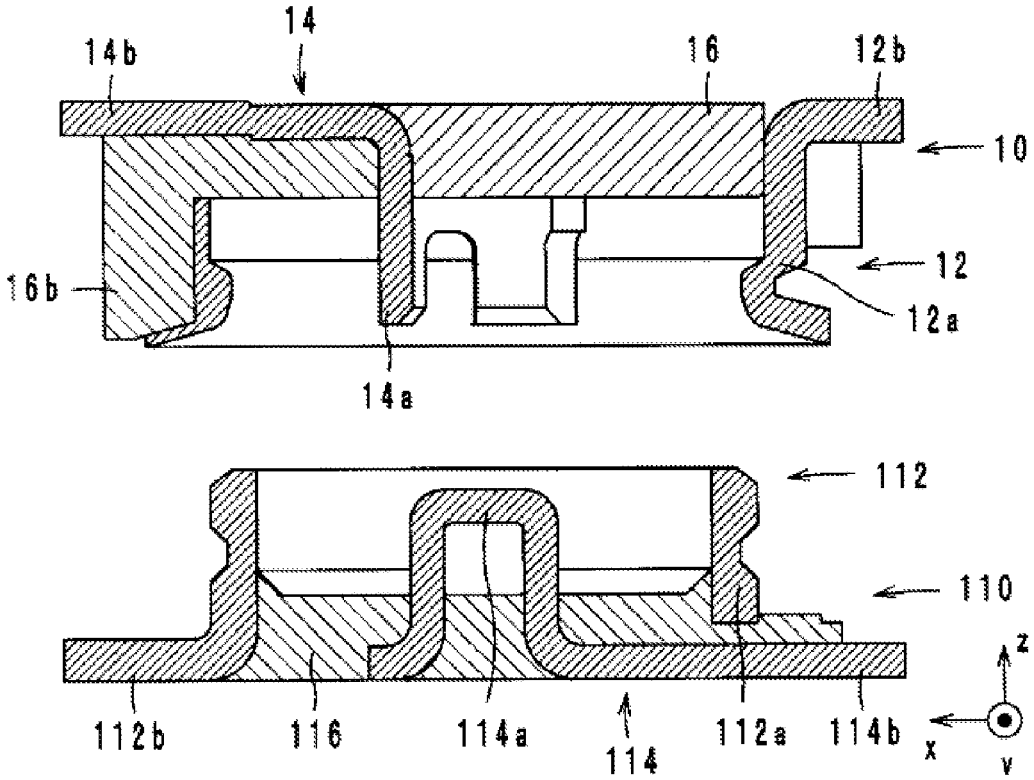
FIG. 12A is a cross-sectional structure diagram of the coaxial connector plug and the coaxial connector receptacle before attachment.
Figure 12B:
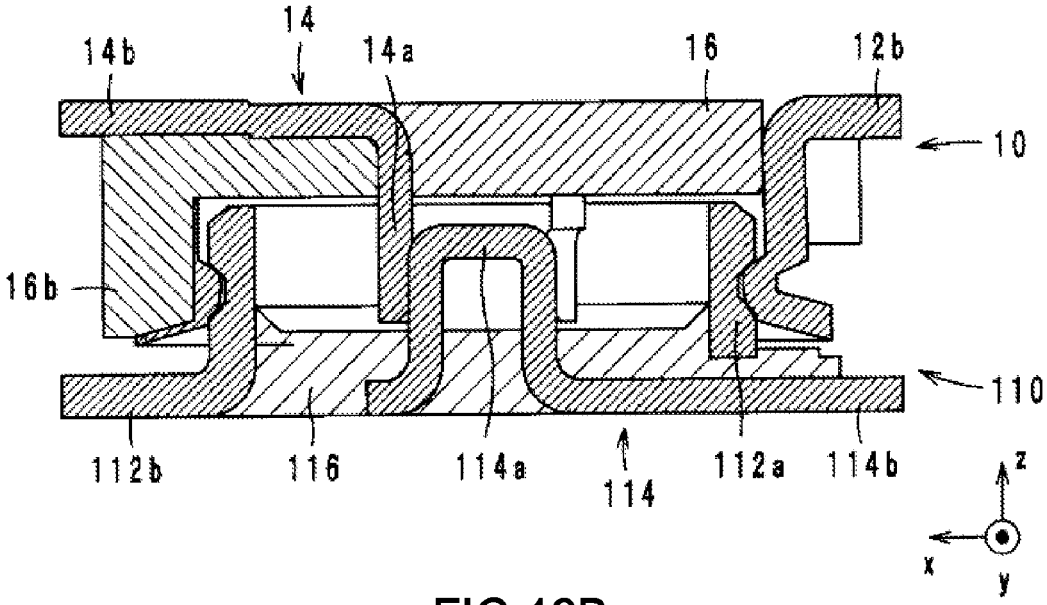
FIG. 12B is a cross-sectional structure diagram of the coaxial connector plug and the coaxial connector receptacle after the attachment.

The attachment of the coaxial connector receptacle 110 to the coaxial connector plug 10 will be described below with reference to drawings. FIG. 12A is a cross-sectional structure diagram of the coaxial connector plug 10 and the coaxial connector receptacle 110 before the attachment. FIG. 12B is a cross-sectional structure diagram of the coaxial connector plug 10 and the coaxial connector receptacle 110 after the attachment. As illustrated in FIG. 12A, the coaxial connector plug 10 is used with an opening of the outer conductor 12*a* facing in the negative z-axis direction. Then, as illustrated in FIG. 12B, the coaxial connector receptacle 110 is attached to the coaxial connector plug 10 from the negative z-axis direction side. Specifically, the outer conductor 112*a* is inserted into the outer conductor 12*a* from the negative z-axis direction side. The diameter of an outer circumferential surface of the outer conductor 112*a* is designed to be slightly larger than the diameter of an inner circumferential surface of the outer conductor 12*a*. Therefore, the outer circumferential surface of the outer conductor 112*a* comes into pressure-contact with the inner circumferential surface of the outer conductor 12*a*, and the outer conductor 12*a* is pressed and extended in the horizontal direction by the outer conductor 112*a*. That is, the outer conductor 12*a* extends to increase the overall width of the slit S. Then, irregularities of the inner circumferential surface of the outer conductor 12*a* and irregularities of the outer circumferential surface of the outer conductor 112*a* engage each other. Thereby, the outer conductor 12*a* holds the outer conductor 112*a*. When in use, the outer conductors 12*a* and 112*a* are maintained at a ground potential.

Further, the central conductor 14*a* is connected to the central conductor 114*a*. Specifically, as illustrated in FIG. 12B, the central conductor 114*a* is inserted into the substantially cylindrical central conductor 14*a*. The diameter of an outer circumferential surface of the central conductor 114*a* is designed to be slightly larger than the diameter of an inner circumferential surface of the central conductor 14*a*. Therefore, the outer circumferential surface of the central conductor 114*a* comes into pressure-contact with the inner circumferential surface of the central conductor 14*a*, and the central conductor 14*a* is pressed and extended by the central conductor 114*a* to be warped in the horizontal direction. Thereby, the central conductor 14*a* holds the central conductor 114*a*. When in use, the central conductors 14*a* and 114*a* are applied with high-frequency signal current.

According to the coaxial connector plug 10 configured as described above, a reduction in height thereof is achieved. More specifically, in the coaxial connector plug 10, the positive z-axis direction-side end portion of the outer conductor 12*a* is in contact with the upper surface S1, and the outer terminals 12*c* and 12*d* are in contact with the lower surface S2 at the sides L1 and L2, respectively. Accordingly, the insulator 16 is nipped by the outer conductor portion 12 from the opposite sides in the z-axis direction. In the coaxial connector plug 10, therefore, the front end bent piece 516*a* of the connector plug 510 described in Patent Document 1 is unnecessary. Accordingly, the cutout for forming the front end bent piece 516*a* is not required to be provided in the outer conductor 12*a* in the coaxial connector plug 10. Consequently, a reduction in height of the outer conductor 12*a* in the z-axis direction is achieved in the coaxial connector plug 10.

Further, since the cutout for forming the front end bent piece 516*a* is not required to be provided in the outer conductor 12*a* in the coaxial connector plug 10, the strength of the outer conductor 12*a* is improved. Consequently, the outer conductor 12*a* is firmly engaged with the outer conductor 112*a*.

Further, since the cutout for forming the front end bent piece 516*a* is not required to be provided in the outer conductor 12*a* in the coaxial connector plug 10, the entire outer conductor 112*a* is uniformly deformed when the outer conductor 12*a* is engaged with the outer conductor 112*a*. Consequently, plastic deformation of the outer conductor 12*a* with stress concentrated on a specific position of the outer conductor 12*a* is suppressed.

Further, according to the coaxial connector plug 10, each of the outer terminals 12*c* and 12*d* is in contact with the lower surface S2 at the opposite ends thereof. Accordingly, the outer conductor portion 12 holds portions of the insulator 16 near four corners thereof. Consequently, easy disengagement of the outer conductor portion 12 from the insulator 16 is suppressed.

Further, the coaxial connector plug 10 is easily manufacturable. More specifically, in the connector plug 510 described in Patent Document 1, the front end bent piece 516*a* and the rear end bent piece 516*b* nip the insulating housing 518, and thereby the insulating housing 518 is fixed to the outer conductor 516. Therefore, the front end bent piece 516*a* is bent, and thereafter the insulating housing 518 is attached to the outer conductor 516. Thereafter, the rear end bent piece

516*b* is bent. Therefore, the manufacturing process of the connector plug 510 is complicated.

Meanwhile, in the coaxial connector plug 10, the outer conductor portion 12 is attached to the insulator 16, and thereafter the outer terminals 12*c* and 12*d* are nipped in the horizontal direction and thereby are plastically deformed to bring the outer terminals 12*c* and 12*d* into contact with the lower surface S2 of the base portion 16*a*. It is therefore unnecessary to perform the bending process on the outer conductor portion 12 a plurality of times. Further, as illustrated in FIGS. 7A and 7B, the simply structured tools T1 and T2 are usable in the plastic deformation of the outer terminals 12*c* and 12*d*. Accordingly, the coaxial connector plug 10 is more easily manufacturable than the connector plug 510 described in Patent Document 1.

Further, in the coaxial connector plug 10, the outer terminals 12*c* and 12*d* are each bent in the direction separating from the outer conductor 12*a* in the plan view in the z-axis direction. Thereby, the outer terminals 12*c* and 12*d* and the outer terminal 14*b* are separated from each other. Consequently, short circuit occurring between the outer terminals 12*c* and 12*d* and the outer terminal 14*b* is suppressed. Further, since short circuit does not easily occur between the outer terminals 12*c* and 12*d* and the outer terminal 14*b*, it is possible to increase the area of the outer terminals 12*c* and 12*d*. Consequently, the area of the outer terminals 12*c* and 12*d* used for soldering is increased in the process of mounting the coaxial connector plug 10 onto a circuit board. Accordingly, it is possible to more firmly fix the coaxial connector plug 10 to the circuit board.

Further, in the coaxial connector plug 10, the reduction in height thereof is also achieved for the following reason. More specifically, in the connector plug 510, the rear end bent piece 516*b* is bent after the attachment of the insulating housing 518 to the outer conductor 516. Therefore, the rear end bent piece 516*b* acts to rise from the insulating housing 518 owing to the spring-back effect. As a result, the height of the connector plug 510 is increased.

Meanwhile, in the coaxial connector plug 10, the outer conductor portion 12 is attached to the insulator 16 with the outer terminals 12*c* and 12*d* bent. Therefore, spring-back does not occur in the outer terminals 12*c* and 12*d*. Consequently, the reduction in height of the coaxial connector plug 10 is achieved.

As described above, exemplary embodiments in accordance with the present disclosure are useful in a coaxial connector plug and a manufacturing method thereof, and are particularly superior in achieving a reduction in height of a coaxial connector plug.

While exemplary embodiments have been described above, it is to be understood that variations and modifications will be apparent to those skilled in the art without departing from the scope and spirit of the disclosure.

What is claimed is:

1. A coaxial connector plug comprising:

a first outer conductor portion including a first outer conductor formed into a substantially cylindrical shape extending in an axial direction, and a pair of outer terminals drawn toward a side of the first outer conductor that faces in the axial direction, the outer terminals each bent in a direction outwardly from the first outer conductor and facing each other across the first outer conductor in a plan view;

an insulator having a pair of oppositely facing sides, a first surface in contact with a lower end of the first outer conductor, and a second surface opposite the first surface in contact with the pair of outer terminals at the pair of oppositely facing sides, to thereby be nipped by the first outer conductor and the pair of outer terminals in the axial direction; and a first central conductor attached to the insulator, and provided in a region projecting into and surrounded by the first outer conductor.

2. The coaxial connector plug according to claim 1, wherein the first outer conductor is configured such that a substantially cylindrical second outer conductor of a coaxial connector receptacle is insertable therein, and wherein the first central conductor is configured such that a second central conductor of the coaxial connector receptacle is connectable thereto.

3. The coaxial connector plug according to claim 1, wherein the insulator is substantially plate-shaped.

4. A manufacturing method of the coaxial connector plug according to claim 1, the manufacturing method comprising:

a first step of attaching the first outer conductor portion to the insulator attached with the first central conductor; and a second step of nipping the pair of outer terminals in the horizontal direction and thereby plastically deforming the pair of outer terminals to bring the pair of outer terminals into contact with the lower surface of the insulator.

5. The coaxial connector plug according to claim 1, wherein the first central conductor is surrounded in said region in a same plane by the first outer conductor.

6. The coaxial connector plug according to claim 1, wherein the pair of outer terminals extend along the sides of the insulator, and each has opposite ends making said contact with the second surface of the insulator.

7. The coaxial connector plug according to claim 6, wherein the first outer conductor is configured such that a substantially cylindrical second outer conductor of a coaxial connector receptacle is insertable therein, and wherein the first central conductor is configured such that a second central conductor of the coaxial connector receptacle is connectable thereto.

8. The coaxial connector plug according to claim 6, wherein a central portion of each of the pair of outer terminals extending along one of the sides of the insulator does not contact the lower surface of the insulator.

9. The coaxial connector plug according to claim 8, wherein each central portion is positioned in a cutout formed along one of the oppositely facing sides of the insulator.

10. A coaxial connector plug comprising:

a first outer conductor portion including a first outer conductor formed into a substantially cylindrical shape extending in an axial direction, and a pair of outer terminals drawn toward a side of the first outer conductor that faces in the axial direction, the outer terminals each bent in a direction outwardly from the first outer conductor and facing each other across the first outer conductor in a plan view;

an insulator having a pair of oppositely facing sides, a first surface in contact with a lower end of the first outer conductor, and a second surface opposite the first surface in contact with the pair of outer terminals at the pair of oppositely facing sides, to thereby be nipped by the first outer conductor and the pair of outer terminals in the axial direction; and a first central conductor attached to the insulator, and provided in a region projecting into and surrounded by the first outer conductor;

each of the pair of outer terminals including a central portion positioned in a cutout formed along one of the oppositely facing sides of the insulator.

11. A coaxial connector plug comprising:

a first outer conductor portion including a first outer conductor formed into a substantially cylindrical shape extending in an axial direction, and a pair of outer terminals drawn toward a side of the first outer conductor that faces in the axial direction, the outer terminals each bent in a direction outwardly from the first outer conductor and facing each other across the first outer conductor in a plan view;

an insulator having a pair of oppositely facing sides, a first surface in contact with a lower end of the first outer conductor, and a second surface opposite the first surface in contact with the pair of outer terminals at the pair of oppositely facing sides, to thereby be nipped by the first outer conductor and the pair of outer terminals in the axial direction; and a first central conductor attached to the insulator, and provided in a region projecting into and surrounded by the first outer conductor;

each of the pair of outer terminals including a central portion, a first bendable portion extending from the central portion in a first direction to form a first distal end, and a second bendable portion extending from the central portion in a second direction opposite the first direction to form a second distal end, wherein the central portion, the first distal end, and the second distal end are positioned in a common plane substantially perpendicular to the axial direction.

* * * * *